United States Patent [19]

Habdas

[11] 4,086,959

[45] May 2, 1978

[54] AUTOMOTIVE OIL COOLER

[75] Inventor: Edward P. Habdas, Dearborn Heights, Mich.

[73] Assignee: UOP Inc., Des Plaines, Ill.

[21] Appl. No.: 706,861

[22] Filed: Jul. 19, 1976

[51] Int. Cl.[2] ..... F28D 7/10

[52] U.S. Cl. ..... 165/155; 165/141; 165/156; 165/184; 184/104 B

[58] Field of Search ..... 165/109 T, 140, 141, 165/154, 155, 156, 184; 184/104 B

[56] References Cited

U.S. PATENT DOCUMENTS

| | | | |
|---|---|---|---|
| 2,870,999 | 1/1959 | Söderström | 165/156 |
| 3,177,936 | 4/1965 | Walter | 165/109 T |
| 3,362,058 | 1/1968 | Morris et al. | 165/184 |
| 3,643,733 | 2/1972 | Hall et al. | 165/154 |
| 3,730,229 | 5/1973 | D'Onofrio | 165/184 |
| 3,829,285 | 8/1974 | Beck | 165/154 |
| 3,983,932 | 10/1976 | Yamaguchi et al. | 165/154 |

FOREIGN PATENT DOCUMENTS

| | | | |
|---|---|---|---|
| 569,027 | 1/1932 | Germany | 165/156 |
| 176,360 | 8/1961 | Sweden | 165/109 T |
| 579,610 | 8/1946 | United Kingdom | 165/184 |
| 615,937 | 1/1949 | United Kingdom | 165/154 |
| 977,579 | 12/1964 | United Kingdom | 165/154 |

*Primary Examiner*—Charles J. Myhre
*Assistant Examiner*—Sheldon Richter
*Attorney, Agent, or Firm*—James R. Hoatson, Jr.; Barry L. Clark; William H. Page, II

[57] ABSTRACT

Submerged oil cooler for automotive vehicles requires only two pricipal parts but can provide more heat transfer at a lower pressure drop than conventional oil coolers which utilize three principal parts. In a preferred embodiment, an outer tube having a helically corrugated surface is hand press fit over an inner tube having an outer surface which is helically finned and has rows of longitudinal grooves formed in the fins. The tubes are sealed at their ends so as to define an extended annular flow channel for oil between the tubes, while permitting engine coolant in which the cooler is submerged to flow through the inner tube. In a modified arrangement, longitudinally milled slots are substituted for the formed grooves.

11 Claims, 8 Drawing Figures

OIL
$H_2O$

AUTOMOTIVE OIL COOLER

BACKGROUND OF THE INVENTION liquid-to-liquid heat exchangers for use submerged in an automobile radiator for transferring heat from the transmission oil to the engine liquid coolant are generally constructed of three major items, a cylindrical outer tube, a cylindrical inner tube, and a turbulator constructed from formed strip sandwiched between the tubes. There are a number of disadvantages to this construction, as for example: there are three separate major items to manufacture and assemble; the additional heat transfer area provided by the turbulator strip communicates to the heat sink (engine coolant) through a mechanical bond with resulting thermal resistance, the value of which depends upon the pressure exerted between the components; the heat exchanger surface presented to the engine coolant is smooth and has no enhanced heat transfer characteristics; and finally, the increased heat transfer characteristics are gained by turbulating the entire fluid path with an attendant, and undesirable, pressure drop increase.

The aforementioned disadvantages of existing oil coolers are not inconsequential. Being able to obtain equivalent performance at a lower cost is always desirable. However, in the case of some automotive applications, the use of smaller engines and the desire for lower hood profiles has resulted in the adoption of radiators of a very small size which place absolute limits on the amount of space available for a submerged oil cooler. A typical oil cooler for a small car has a maximum length of about 11½ inches and an outside diameter of about 1 inch. A cooler made in such a size in the conventional manner is adequate for most purposes but can prove to have insufficient oil cooling capacity for certain extreme driving conditions which place additional demands on the transmission. It would thus be desirable to have an oil cooler which could transfer more heat than conventional coolers of the same size, do so with the same or a lesser degree of pressure drop, and do so at the same or a lower cost than present coolers. A cooler disclosed in my copending application Ser. No. 574,989, filed May 27, 1975, accomplishes these goals by means of a two-piece unit having an outer tube which incorporates a plurality of longitudinal flutes which are periodically transversely indented and press fit over an inner tube having a helically finned outer surface. However, the disclosed cooler is not too readily manufacturable on available equipment and it is therefore desirable to have a cooler which can be made more easily using existing equipment.

SUMMARY OF THE INVENTION

It is among the objects of the present invention to provide an improved oil cooler which is more efficient than prior art coolers and/or easier to produce than prior art coolers. A preferred embodiment utilizes an inside tube having helical fins on its outer surface which are longitudinally grooved by being deformed, such as by means of a series of pins, with the fins in adjacent grooves being oppositely bent over. In a modification, the longitudinal grooves in the fins of the inner tube are formed by milling slots in the fins. In each embodiment, the inner tube is press fit by hand into a corrugated outer tube. The modified embodiment results in a cooler with somewhat less performance than the preferred embodiment while offering an alternative method of machining a tube with slightly less material in its fins. Each embodiment was found to provide improved heat transfer performance as compared to a conventional turbulator type cooler at oil flow rates of 1–3 gallons per minute. The pressure drop of the preferred embodiment was found to be lower than the conventional cooler while the modified embodiment had a higher pressure drop.

DESCRIPTION OF THE PREFERRED EMBODIMENT

Figures 1, 2, 3, 4, 5, 6:
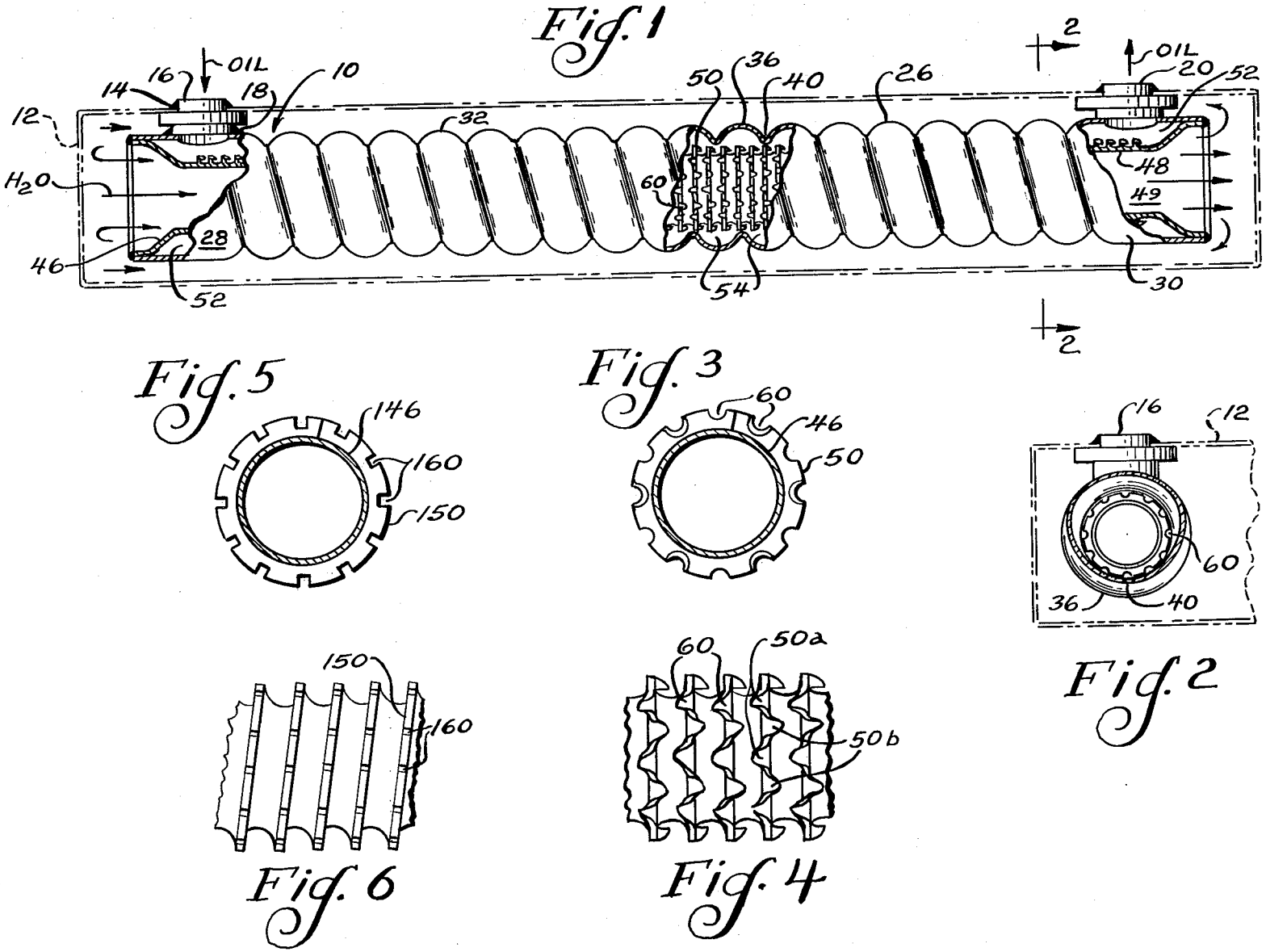
FIG. 1 is a fragmentary, partially sectioned top view of a preferred embodiment of an improved oil cooler shown in operative relationship with a radiator lower tank element (shown in phantom) in which it is mounted.
FIG. 2 is a sectional view taken on the line 2—2 of FIG. 1.
FIG. 3 is a transverse cross-section of the inner tube having bent over fins shown in FIGS. 1, 2 and 4.
FIG. 4 is an enlarged fragmentary side view of the inner tube shown in FIGS. 1–3.
FIG. 5 is a view similar to FIG. 3 but shows a modified inner tube having milled slots in its fins.
FIG. 6 is a fragmentary side view, similar to FIG. 4, of the modified inner tube shown in FIG. 5.

Referring to FIG. 1, my improved submerged oil cooler indicated generally at 10 is shown in operative relation to a radiator lower tank element 12 (indicated in phantom lines) in which it is mounted and to which it is sealed by appropriate fastening means such as solder bead 14. Mounted at one end of the oil cooler 10 is an inlet member 16 having internal threads for receiving a transmission oil cooling line (not shown). The inlet member 16 is preferably fastened to the oil cooler by a solder bead 18. Similarly, a transmission oil outlet member 20 is soldered or brazed to the tank element 12. The inlet and outlet fittings 16, 20 are attached to an outer tubular corrugated shell member 26 at smooth end portions 28, 30 thereof. The shell member 26 includes a central corrugated portion 32 between the smooth end portions 28, 30, the corrugated portion 32 being defined by a plurality of outer crest portions 36 and inner root portions 40.

An inner tube 46 is hand press fit into the outer tube or shell member 26 and soldered thereto at 47 so as to form a two-tube composite. The inner tube 46 has a smooth inner surface 48 which defines the interior wall of central aperture 49. The aperture 49 passes through the entire length of the cooler 10 and is adapted to receive cooling water within the radiator flowing in the direction of the arrows toward the radiator outlet (not shown). The outer surface of inner tube 46 has helical fins 50 which provide an extended heat transfer surface in contact with transmission oil flowing through the oil distribution chamber 52 defined by the fins 50 on the inner tube 46 and the internal walls of the outer shell member 26. As oil flows through the chamber 52 from inlet 16 to outlet 20, it moves through a series of short longitudinal axial chambers 54 which are defined externally by the inner wall of tube 26 between axially adjacent inner root portions 40. The oil passes from chamber to chamber in two paths. The major path is along longitudinal grooves 60 formed by bending over alternately peripherally spaced portions 50*a*, 50*b* of the fins 50 in opposite directions. The secondary path being helical as defined by the corrugation pitch of the outer shell 26. The longitudinal path is similar to a number of small diameter tubes having a high roughness factor due to the fin tips and which is periodically restricted by the inward protrusions 40 of the outer corrugated tube so as to form periodic orifices for turbulence. The helical path forces the oil to flow between the finned surfaces 50 of the inner tube 46 and takes advantage of the very high surface area available. These paths promote two oil flow patterns at an angle of between 45° and 90° of each other which inter-react at each groove 60 to cause oil mixing to occur. The number of these mixing areas is very high, being equal to the number of grooves 60 around the circumference times the cooler length divided by the corrugation pitch. In the preferred embodiment of FIGS. 1–4, the various parameters are in the following range of dimensions: inner tube fins 50 preferably have 11 to 26 fins per inch at a height of 0.040 to 0.080 inch. The groove radius of the grooves 60 in the fins 50 is preferably 0.020 to 0.060 inch at a groove depth of from 0.015 to 0.050 inch. The outer tube 26 preferably has a corrugation pitch from 0.250 to 0.750 inch at a corrugation depth of from 0.040 to 0.090 inch. For the modified inner tube embodiment of FIGS. 5 and 6, the milled slots 150 preferably range from 0.060 to 0.080 inch wide with a depth range of 0.020 to 0.050 inch. The number of grooves 160 in the modified tube 146 is preferably from 6 to 24 circumferentially. Similarly, the number of grooves 60 in tube 46 is preferably from 6 to 24.

The corrugations 32 on outer tube 26 provide slightly more heat transfer surface area than a smooth tube but the additional surface provides a beneficial heat transfer effect which is much less than the improvement obtained due to the turbulence created in the axial flow of engine coolant. Since the fins 50, which have a large surface area, are integral with the inner tube 46 which is in contact with the engine coolant passing through the center of the cooler, there can be no bond resistance and thus the heat transfer efficiency is higher than in a prior art cooler where the turbulator is mechanically bonded.

Figure 7:
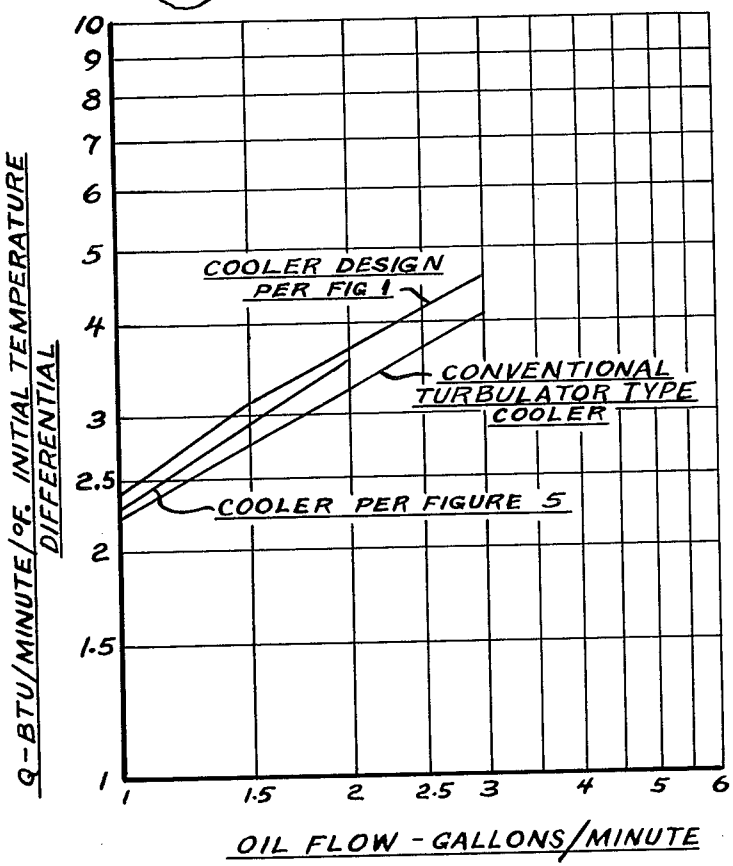
FIG. 7 is a graph plotting the heat load, Q, against the rate of oil flow through the cooler and compares the oil coolers utilizing the inner tubes of FIGS. 4 and 6 to a conventional submerged turbulator type cooler.

Referring to FIG. 7, one can see a graphic comparison of heat transfer for various oil flow rates for an oil cooler made in accordance with FIG. 1, a conventional turbulator type cooler, and a modified oil cooler. The modified cooler is identical to FIG. 1 except that the inner tube 46 is replaced by the tube 146 of FIGS. 5 and 6, having grooves 160 having milled notches in the fins 150. The tube 46 of FIGS. 1–4 has grooves 60 formed by bending over portions 50*a*, 50*b* of the fins 50. The graph shows that the heat value Q, as measured in BTU per minute per ° F. of initial temperature differential, is greater for both the preferred cooler design of FIG. 1 and the modified design of FIG. 5 than it is for the conventional cooler tested.

Figure 8:
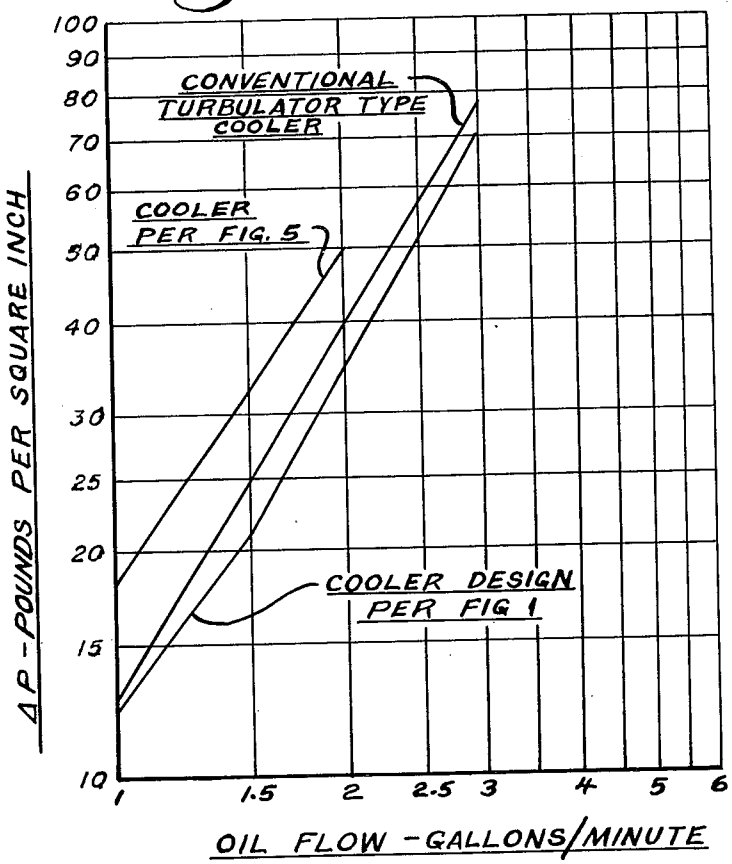
FIG. 8 is a graph similar to FIG. 7 except that it plots pressure drop, $\Delta P$, against the rate of oil flow.

FIG. 8 shows a graphic comparison of the pressure drop, $\Delta P$, in pounds per square inch at different flow rates, for the cooler designs of FIGS. 1 and 5 and for a conventional cooler. The results indicate that the preferred embodiment of FIG. 1 offers a lower pressure drop than the conventional cooler while the FIG. 5 design provides a higher pressure drop.

The coolers tested were made as follows:

Cooler per FIG. 1: Outer tube 26 was a 1 inch OD × 0.025 inch wall tube corrugated to a pitch of 0.379 inch and a depth of corrugation of 0.088 inch. The inner tube 46 was a finned tube with 19.6 fins per inch, with a height of 0.058 inch. The grooves were formed with a tool of tip radius of 1/16 inch to a depth of 0.026 inch. Alternate grooves 60 were bent in opposite directions and there were 12 grooves total. The oil connections were spaced at 10 inch and the overall cooler length was 11.5 inches. The finned tube insert fit into the outer tube with a 0.002 inch interference fit.

Cooler per FIG. 5: The outer tube was identical to that used in the FIG. 1 cooler. The inner finned tube 146 was also the same with the exception of the grooves 160. There were 12 grooves which consisted of rectangular slots 0.062 inch wide × 0.020 inch deep. The connections, overall length, and fit were the same as for the FIG. 1 cooler.

Conventional Cooler: The outer tube was 1 inch OD × 0.020 inch wall tube with an inner tube of approximately 0.780 inch OD × 0.020 inch wall. Interposed between the two tubes was a turbulator formed by stamping a configuration onto a thin sheet. This turbulator was then locked between the two tubes by expansion of the inner tube radially outward. The fittings were 10 inches apart and the overall length was 11¼ inches.

I claim as my invention:

1. In a submerged oil cooler for automotive vehicles comprising a hollow inner length of tubing through which engine coolant may flow and an outer length of tubing sealed at its ends to the inner tubing and having an inner surface which cooperates with the outer surface of the inner length of tubing to define a generally annular flow passage for oil which may pass through inlet and outlet fittings at opposed ends of the cooler, the improvement wherein said inner length of tubing includes an integral, generally transversely helically finned outer surface along the major portion of its length and said outer length of tubing is helically corrugated over the major portion of its length to include root portions which are of an internal diameter slightly greater than the external fin diameter of the inner length of tubing and crest portions which are spaced from said fins, said fins being periodically longitudinally grooved around the circumference thereof, whereby the oil flowing through said flow passage will move generally longitudinally in a first path defined by said longitudinal grooves and generally helically in a second path defined by said helical corrugations.

2. A submerged oil cooler in accordance with claim 1 wherein said longitudinal grooves are defined by bent over portions of the tips of the fins on the inner tube.

3. A submerged oil cooler in accordance with claim 2 wherein adjacent grooves aroung the circumference of the inner tube are bent in alternate axial directions.

4. A submerged oil cooler in accordance with claim 1 wherein said longitudinal grooves are defined by slots cut out of the material of the fins on the inner tube.

5. A submerged oil cooler in accordance with claim 1 wherein said inner length of tubing contains between about 6 and 24 longitudinal grooves around the circumference of its fins.

6. A submerged oil cooler in accordance with claim 5 wherein said grooves have a depth of from about 0.015 - 0.050 inches.

7. A submerged oil cooler in accordance with claim 1 wherein said outer length of tubing is helically corrugated at a pitch of about 0.250 - 0.750 inches with said corrugations having a depth of 0.040 - 0.090 inches.

8. A submerged oil cooler in accordance with claim 7 wherein said inner length of tubing includes from about 11-26 integral fins per inch of length.

9. A submerged oil cooler in accordance with claim 1 wherein said outer tubing has about a 1,000 in. OD, a pitch of about 0.379 inches, a depth of corrugation of about 0.088 in., and a wall thickness of about 0.025 in. while said inner tubing has about 19.6 fins per inch with a tip height of 0.058 in., said fins including about 12 circumferentially spaced longitudinal grooves formed by deforming the fin tips with a round nosed tool.

10. A submerged oil cooler in accordance with claim 9 wherein alternate grooves are formed by deforming said fin tips in alternate directions.

11. A submerged oil cooler in accordance with claim 1 wherein said outer tubing has about a 1,000 in. OD, a pitch of about 0.379 inches, a depth of corrugation of about 0.088 in., and a wall thickness of about 0.025 in. while said inner tubing has about 19.6 fins per inch with a tip height of 0.058 in., said fins including about 12 circumferentially spaced longitudinal grooves formed by removing the material of the fin tips to create notches therein.

* * * * *